US005318692A

United States Patent [19]

Eberly, Jr. et al.

[11] Patent Number: 5,318,692

[45] Date of Patent: * Jun. 7, 1994

[54] FCC FOR PRODUCING LOW EMISSION FUELS FROM HIGH HYDROGEN AND LOW NITROGEN AND AROMATIC FEEDS

[75] Inventors: Paul E. Eberly, Jr.; William E. Winter, both of Baton Rouge, La.

[73] Assignee: Exxon Research and Engineering Company, Florham Park, N.J.

[ * ] Notice: The portion of the term of this patent subsequent to May 24, 2011 has been disclaimed.

[21] Appl. No.: 982,916

[22] Filed: Nov. 30, 1992

[51] Int. Cl.[5] ..... C10G 11/05; C10G 11/18

[52] U.S. Cl. ..... 208/120; 208/61; 208/89; 208/113

[58] Field of Search ..... 208/120, 89, 61, 113

[56] References Cited

U.S. PATENT DOCUMENTS 4,260,475 4/1981 Scott ..... 208/113

*Primary Examiner*—R. Bruce Breneman
*Assistant Examiner*—Lorna M. Douyon
*Attorney, Agent, or Firm*—Henry E. Naylor

[57] ABSTRACT

A fluid catalytic cracking process for producing relatively low emissions fuels. The feedstock is relatively low in nitrogen and aromatics and high in hydrogen content and the catalyst is a mixture of zeolite-Y and ZSM-5, or an amorphous acid catalytic material with ZSM-5, or a combination of all three. The feedstock can be characterized as having less than about 50 wppm nitrogen; greater than about 13 wt. % hydrogen; less than about 7.5 wt. % 2+ ring aromatic cores; and not more than about 15 wt. % aromatic cores overall.

8 Claims, No Drawings

FCC FOR PRODUCING LOW EMISSION FUELS FROM HIGH HYDROGEN AND LOW NITROGEN AND AROMATIC FEEDS

FIELD OF THE INVENTION

The present invention relates to a fluid catalytic cracking process for producing low emissions fuels. The feedstock is exceptionally low in nitrogen and aromatics and relatively high in hydrogen content. The catalyst contains a mixture of zeolite Y and ZSM-5, or an amorphous acidic material and ZSM-5, or a combination of all three. The feedstock can be characterized as having less than about 50 wppm nitrogen; greater than about 13 wt. % hydrogen; less than about 7. 5 wt. % 2+ ring aromatic cores; and not more than about 15 wt. % aromatic cores overall.

BACKGROUND OF THE INVENTION

Catalytic cracking is an established and widely used process in the petroleum refining industry for converting petroleum oils of relatively high boiling point to more valuable lower boiling products, including gasoline and middle distillates, such as kerosene, jet fuel and heating oil. The preeminent catalytic cracking process now in use is the fluid catalytic process (FCC) in which a preheated feed is brought into contact with a hot cracking catalyst which is in the form of a fine powder, typically having a particle size of about 10–300 microns, usually about 100 microns, for the desired cracking reactions to take place. During the cracking, coke and hydrocarbonaceous material are deposited on the catalyst particles. This results in a loss of catalyst activity and selectivity. The coked catalyst particles, and associated hydrocarbon material, are subjected to a stripping process, usually with steam, to remove as much of the hydrocarbon material as technically and economically feasible. The stripped particles, containing non-strippable coke, are removed from the stripper and sent to a regenerator where the coked catalyst particles are regenerated by being contacted with air, or a mixture of air and oxygen, at elevated temperature. This results in the combustion of the coke which is a strongly exothermic reaction which, besides removing the coke, serves to heat the catalyst to the temperatures appropriate for the endothermic cracking reaction. The process is carried out in an integrated unit comprising the cracking reactor, the stripper, the regenerator, and the appropriate ancillary equipment. The catalyst is continuously circulated from the reactor or reaction zone, to the stripper and then to the regenerator and back to the reactor. The circulation rate is typically adjusted relative to the feed rate of the oil to maintain a heat balanced operation in which the heat produced in the regenerator is sufficient for maintaining the cracking reaction with the circulating, regenerated catalyst being used as the heat transfer medium. Typical fluid catalytic cracking processes are described in the monograph Fluid Catalytic Cracking with Zeolite Catalysts, Venuto, P. B. and Habib, E. T., Marcel Dekker Inc. N.Y. 1979, which is incorporated herein by reference. As described in this monograph, catalysts which are conventionally used are based on zeolites, especially the large pore synthetic faujasites, zeolites X and Y.

Typical feeds to a catalytic cracker can generally be characterized as being a relatively high boiling oil or residuum, either on its own, or mixed with other fractions, also usually of a relatively high boiling point. The most common feeds are gas oils, that is, high boiling, non-residual oils, with an initial boiling point usually above about 230° C., more commonly above about 350° C., with end points of up to about 620° C. Typical gas oils include straight run (atmospheric) gas oil, vacuum gas oil, and coker gas oil.

While such conventional fluid catalytic cracking processes are suitable for producing conventional transportation fuels, such fuels are generally unable to meet the more demanding requirements of low emissions fuels. To meet low emissions standards, the fuel products must be relatively low in sulfur, nitrogen, and aromatics, especially multiring aromatics. Conventional fluid catalytic cracking is unable to meet such standards. These standards will require either further changes in the FCC process, catalysts, or post-treating of all FCC products. Since post-treating to remove aromatics from gasoline or distillate fuels is particularly expensive, there are large incentives to limit the production of aromatics in the FCC process. Consequently, there exists a need in the art for methods of producing large quantities Of low emissions transportation fuels, such as gasoline and distillates.

SUMMARY OF THE INVENTION

In accordance with the present invention, there is provided a fluid catalytic cracking process for producing low emissions fuel products, which process comprises:

(a) introducing a hydrocarbonaceous feedstock into a reaction zone of a catalytic cracking unit comprised of a reaction zone, a stripping zone, and a regeneration zone, which feedstock is characterized as having: a boiling point from about 230° C. to about 350° C., with end points up to about 620° C.; a nitrogen content less than about 50 wppm; a hydrogen content in excess of about 13 wt. %; a 2+ ring aromatic core content of less than about 7.5 wt. %; and an overall aromatic core content of less than about 15 wt. %;

(b) catalytically cracking said feedstock in said reaction zone at a temperature from about 450° C. to about 600° C., by causing the feedstock to be in contact with a cracking catalyst for a contact time of about 0.5 to 5 seconds, which cracking catalyst contains an effective amount of a mixture of zeolite Y and ZSM-5, or an amorphous acidic material and ZSM-5, or a combination of all three; thereby producing lower boiling products and spent catalyst particles which contain coke and hydrocarbonaceous material;

(c) stripping spent catalyst particles with a stripping medium in a stripping zone to remove therefrom at least a portion of said hydrocarbonaceous material;

(d) recovering said stripped hydrocarbonaceous material from the stripping zone;

(e) regenerating said coked catalyst in a regeneration zone by burning-off a substantial amount of the coke on said catalyst, optionally with an added fuel component, to maintain the regenerated catalyst at a temperature which will maintain the catalytic cracking reactor at a temperature from about 450° C. to about 600° C.; and (f) recycling said regenerated catalyst to the reaction zone.

In preferred embodiments of the present invention, an added fuel component is used in the regeneration zone and is selected from: $C_2^-$ light gases from the catalytic cracking unit, and natural gas.

In preferred embodiments of the present invention the catalyst contains a mixture of an amorphous silica/alumina having about 10 to 40 wt. % alumina and ZSM-5.

In other preferred embodiments of the present invention the contact time in the cracking unit is about 0.5 to 3 seconds.

DETAILED DESCRIPTION OF THE INVENTION

The practice of the present invention results in the production of less aromatic naphtha products or the production of more $C_3$ and $C_4$ olefins which can be converted to high octane, non-aromatic alkylates, such as methyl tertiary butyl ether.

Feedstocks which are suitable for being converted in accordance with the present invention are any of those hydrocarbonaceous feedstocks which are conventional feedstocks for fluid catalytic cracking and which have an initial boiling point of about 230° C. to about 350° C., with an end point up to about 620° C. The feedstocks of the present invention must also contain no more than about 50 wppm nitrogen, no more than about 7.5 wt. % 2+ ring aromatic cores, no more than about 15 wt. % aromatic cores overall, and at least about 13 wt. % hydrogen. Non-limiting examples of such feeds include the non-residual petroleum based oils such as straight run (atmospheric) gas oil, vacuum gas oil, and coker gas oil. Oils from synthetic sources such as coal liquefaction, shale oil, or other synthetic processes may also yield high boiling fractions which may be catalytically cracked, either on their own or in admixture with oils of petroleum origin. Feedstocks which are suitable for use in the practice of the present invention may not be readily available in a refinery. This is due to the fact that typical refinery streams in the boiling point range of interest, which re conventionally used for fluid catalytic cracking, generally contain too high a content of undesirable components such as nitrogen, sulfur, and aromatics. Consequently, such streams will need to be upgraded, or treated to lower the level of such undesirable components. Non-limiting methods for upgrading such streams include hydrotreating in the presence of hydrogen and a supported Mo containing catalyst with Ni and/or Co; extraction methods, including solvent extraction as well as the use of solid adsorbents, such as various molecular sieves. It is preferred to hydrotreat the streams.

Any suitable conventional hydrotreating process can be used as long as it results in a stream having the characteristics of nitrogen, sulfur, and aromatics level previously mentioned. That is nitrogen levels of less than about 50 wppm, preferably less than about 30 wppm, more preferably less than about 15 wppm, and most preferably less that about 5 wppm; a hydrogen content of greater than about 13 wt. %, preferably greater than about 13.5 wt. %; a 2+ ring aromatic core content of less than about 7.5 wt. %, preferably less than about 4 wt. %; and an overall aromatic core content of less than about 15 wt. %, preferably less than about 8 wt. %.

Suitable hydrotreating catalysts are those which are typically comprised of a Group VIB (according to Sargent-Welch Scientific Company Periodic Table) metal with one or more Group VIII metals as promoters, on a refractory support. It is preferred that the Group Vi metal be molybdenum or tungsten, more preferably molybdenum. Nickel and cobalt are the preferred Group VIII metal with alumina being the preferred support. The Group VIII metal is present in an amount ranging from about 2 to 20 wt. %, expressed as the metal oxides, preferably from about 4 to 12 wt. %. The Group VIB metal is present in an amount ranging from about 5 to 50 wt. %, preferably from about 10 to wt. %, and more preferably from about 20 to 30 wt. %. All metals weight percents are based on the total weight of the catalyst. Any suitable refractory support can be used. Such supports are typically inorganic oxides, such as alumina, silica, silica/alumina, titania, and the like. Preferred is alumina.

Suitable hydrotreating conditions include temperatures ranging from about 250° to 450° C., preferably from about 350° C. to 400° C.; pressures from about 250 to 3000 psig; preferably from about 1500 to 2500 psig; hourly space velocities from about 0.05 to 6 V/V/Hr; and a hydrogen gas rate of about 500 to 10000 SCF/B; where SCF/B means standard cubic feet per barrel, and V/V/HR means volume of feed per volume of the catalyst per hour.

A hydrocarbonaceous feedstock which meets the aforementioned requirements for producing a low emissions fuel is fed to a conventional fluid catalytic cracking unit. The catalytic cracking process may be carried out in a fixed bed, moving bed, ebullated bed, slurry, transfer line (dispersed phase) riser or dense bed fluidized bed operation. It is preferred that the catalytic cracking unit be a fluid catalytic cracking (FCC) unit. Such a unit will typically contain a reactor where the hydrocarbonaceous feedstock is brought into contact with hot powdered catalyst particles which were heated in a regenerator. Transfer lines connect the two vessels for moving catalyst particles back and forth. The cracking reaction will preferably be carried out at a temperature from about 450° to about 680° C., more preferably from about 480° to about 560° C.; pressures from about 5 to 60 psig, more preferably from about 5 to 40 psig; contact times (catalyst in contact with feed) of about 0.5 to 10 seconds, more preferably about 1 to 6 seconds; and a catalyst to oil ratio of about 0.5 to 15, more preferably from about 2 to 8. During the cracking reaction, lower boiling products are formed and some hydrocarbonaceous material, and non-volatile coke are deposited on the catalyst particles. The hydrocarbonaceous material is removed by stripping, preferably with steam. The non-volatile coke is typically comprised of highly condensed aromatic hydrocarbons which generally contain about 4 to 10 wt. % hydrogen. As hydrocarbonaceous material and coke build up on the catalyst, the activity of the catalyst for cracking, and the selectivity of the catalyst for producing gasoline blending stock, are diminished. The catalyst particles can recover a major proportion of their original capabilities by removal of most of the hydrocarbonaceous material by stripping and the coke by a suitable oxidative regeneration process. Consequently, the catalyst particles are sent to a stripper and then to a regenerator.

Catalyst regeneration is accomplished by burning the coke deposits from the catalyst surface with an oxygen-containing gas such as air. Catalyst temperatures during regeneration may range from about 560° C. to about 760° C. The regenerated, hot catalyst particles are then transferred back to the reactor via a transfer line and, because of their heat, are able to maintain the reactor at the temperature necessary for the cracking reactions. Coke burn-off is an exothermic reaction, therefore in a conventional fluid catalytic cracking unit with conventional feeds, no additional fuel needs to be added. The feedstocks used in the practice of the present invention, primarily because of their low levels of aromatics, and also due to the relatively short contact times in the reactor or transfer line, may not deposit enough coke on the catalyst particles to achieve the necessary temperatures in the regenerator. Therefore, it may be necessary to use an additional fuel to provide increased temperatures in the regenerator so the catalyst particles returning to the reactor are hot enough to maintain the cracking reactions. Non-limiting examples of suitable additional fuel include $C_2^-$ gases from the catalytic cracking process itself; natural gas; and any other non-residual petroleum refinery stream in the appropriate boiling range. Such additional fuels are sometimes referred to as torch oils. Preferred are the $C_2^-$ gases.

Catalysts suitable for use in the present invention are mixtures of zeolite-Y and ZSM-5 or a mixture of an amorphous acidic material and ZSM-5. That is, the amorphous acidic material can take the place of zeolite-Y in the mixture. It is preferred that the amorphous acidic material have a surface area after commercial deactivation, or after steaming at 760° C. for 16 hrs, from about 75 to 200 $m^2/g$, more preferably from about 100 to 150 $m^2/g$. Amorphous acidic catalytic materials suitable for use herein include: alumina, silica-alumina, silica-magnesia, silica-zirconia, silica-thoria, silica-beryllia, silica-titania, and the like. Most preferred is a silica-alumina material having from about 10 to 40 wt. % alumina, preferably from about 15 to 30 wt. % alumina. Such materials will typically have a pore volume of at least about 0.3cc per gram. In general, higher pore volumes are preferred as long as they are not so high as to adversely affect the attrition resistance of the catalyst. Thus, the pore volume of the amorphous catalytic material will be at least about 0.3cc per gram, preferably from about 0.4 to 1.5cc per gram, and more preferably from about 0.4 to 0.6cc per gram., This amorphous acidic material is different than the conventional oxide material used as a matrix for catalysts for fluid catalytic cracking. For example, such conventional matrix materials typically have a surface area of about 40 to 50 $m^2/g$.

The zeolite portion of the catalyst composite will typically contain from about 5 wt. % to 95 wt. % zeolite-Y and the balance of the zeolite portion being ZSM-5. By zeolite-Y is meant those zeolites which are isostructural with zeolite-Y, or faujasite, and have a unit cell size from 24.21 to 24.40 Å after equilibration in the cracking unit. More preferably, it should have a unit cell size between 24.21 and 24.30 Å. Still more preferably, it should have a unit cell size less than 24.25 Å. It can be used in a variety of ion-exchanged forms including the rare earth, hydrogen, and USY (ultrastable Y) modifications. The particle size of the zeolite may range from about 0.1 to 10 microns, preferably from about 0.3 to 3 microns.

ZSM-5 has been described in U.S. Pat. No. 3,702,886 and also in *Nature*, 272, pages 437–438, Mar. 30, 1978. It is generally described as a small pore zeolite having an effective pore diameter between that of zeolite A and that of zeolite Y.

The zeolite will be mixed with a suitable porous matrix material when used as a catalyst for fluid catalytic cracking. Non-limiting porous matrix materials which may be used in the practice of the present invention include alumina, silica/alumina, silica/magnesia, &, silica/zirconia, silica/thoria, silica/beryllia, silica/titania, alumina/boria, as well as ternary compositions, such as silica/alumina thoria, silica/alumina/zirconia, magnesia and silica/magnesia/zirconia.

The matrix may also be in the form of a cogel. The relative proportions of zeolite component nd inorganic oxide gel matrix on an anhydrous basis may vary widely with the zeolite content, ranging from about 10 to 99, more usually from about 10 to 80 percent by weight of the dry composite. The matrix itself may possess catalytic properties, generally of an acidic nature.

Suitable amounts of zeolite component in the total catalyst will generally range from about 1 to about 60, preferably from about 1 to about 40, and more preferably from about 5 to about 40 wt. %, based on the total weight of the catalyst. Generally, the particle size of the total catalyst will range from about 10 to 300 microns in diameter, with an average particle diameter of about 60 microns. The surface area of the matrix material will be about $\leqq 350$ $m^2/g$, preferably 100 $m^2/g$, more preferably from about 50 to 100 $m^2/g$. While the surface area of the final catalysts will be dependent on such things as type and amount of zeolite material used, it will usually be less than about 500 $m^2/g$, preferably from about 20 to 300 $m^2/g$, more preferably from about 30 to 250 $m^2/g$.

The following examples are presented to illustrate preferred embodiments of the present invention and should not be taken as being limiting in any way.

EXAMPLE 1 (COMPARATIVE)

Cracking tests were conducted in a small fixed bed microactivity test (MAT) unit. Such a test unit is described in the *Oil and Gas journal*, 1966 Vol. 64, pages 7, 84, 85; and Nov. 22, 1971, pages 60–68, which is incorporated herein by reference. Run conditions selected are listed as follows:

| | |
|---|---|
| Temperature, °C. | 525 |
| Run Time, Sec. | 30 |
| Catalyst Charge, gr. | 4.1 |
| Amount Feed, cc. | 1.1 |
| Cat/Oil ratio | 4.2 to 4.5 |

The feed for these tests was the 345° C.+ fraction of raw Arab Light virgin gas oil (VGO). This is a typical conventional fluid catalytic cracking feed and is designated by RA and the 345° C.+ fraction of RA is designated RA+. Properties of this feed are given below.

| Feed "RA" Properties | |
|---|---|
| Wppm N | 596 |
| Wt % S | 1.99 |
| Wt % C | 85.86 |
| Wt % H | 12.09 |
| Wt % Sats | 47.8 |
| Wt % 1 Ring Aromatics | 17.8 |
| Wt % Total Aromatic Cases | 21.5 |
| Wt % 2 + R Aromatic Cases | 16.8 |

Two catalysts were used in these tests. The first was a fresh, steamed, commercially available catalyst (Davison's Octacat-D) which is designated as catalyst ZA. The catalyst was steamed 16 hours at 760° C. to simulate commercially deactivated catalysts. Catalyst ZA contains a USY zeolite but no rare earths. It is formulated in a silica/sol matrix. It is a relatively low unit cell size catalyst, after steaming or commercial deactivation. Tests were also made with a fresh, steamed ZSM-5 additive (Intercat's ZCAT+) which contains about 15% ZSM-5 zeolite in a matrix. This catalyst is designated ZZ. Runs were made with each catalyst and with mixtures of the two catalysts in various proportions.

| CATALYST PROPERTIES | ZA | ZZ |
|---|---|---|
| Catalyst/Additive Wt % | | |
| $Al_2O_3$ | 26.0 | 36.6 |
| $SiO_2$ | 73.0 | 54.4 |
| $Re_2O_3$ | 0.02 | 0.03 |
| $Na_2O$ | 0.25 | 0.2 |
| Calc. 4 hrs @ 540° C. | | |
| S.A., $M^2/g$ | 297.5 | 59.2 |
| P.V., cc/g | 0.24 | 0.152 |
| Unit Cell, Å | 24.44 | n/a |
| Stmd 16 hrs @ 760° C. | | |
| S.A., $M^2/g$ | 199.5 | 66.1 |
| P.V., cc/g | 0.20 | 0.157 |
| Unit Cell, Å | 24.25 | n/a |

The total liquid product from the MAT tests amounting to about 0.3 to 0.7 grams was analyzed on two different gas chromatograph instruments. A standard analysis is the boiling point distribution determined by gas chromatograph distillation to evaluate: (1) the amount of material boiling less than 15° C., (2) the naphtha boiling between 15° C. and 220° C., (3) the light cycle oil boiling between 220° C. and 345° C., and (4) the bottoms boiling above 345° C. For selected tests, another portion of the sample was analyzed on the PIONA instrument which is a multidimensional gas chromatograph (using several columns) to determine the molecular types according to carbon number from $C_3$ to $C_{11}$. The types include normal paraffins, isoparaffins, naphthenes, normal olefins, iso-olefins, cyclo-olefins, and aromatics.

Detailed cracking data are given in Table I below for cracking the raw Arab Light VGO feed with these catalysts and catalyst mixtures.

TABLE I

Cracking of Raw Arab Lt VGO on Catalysts ZA and ZZ

| | | | | |
|---|---|---|---|---|
| % Catalyst ZA | 100 | 80 | 40 | 20 |
| % Catalyst ZZ | 0 | 20 | 60 | 80 |
| Conversion (220° C.) | 67.1 | 66.3 | 55.0 | 45.8 |
| Yields, Wt % | | | | |
| Coke | 2.35 | 2.10 | 1.33 | 0.55 |
| $C_2-$ *Dry Gas* | 2.17 | 2.76 | 4.29 | 4.05 |
| $C_3H_6$ | 4.74 | 11.20 | 10.82 | 9.36 |
| $C_3H_8$ | 0.95 | 1.72 | 2.65 | 2.42 |
| $C_4H_8$ | 5.9 | 10.2 | 9.1 | 8.1 |
| Iso-$C_4H_{10}$ | 4.19 | 5.34 | 3.77 | 2.30 |
| N—$C_4H_{10}$ | 0.88 | 0.89 | 1.16 | 1.10 |
| 15/220° C. | 45.9 | 32.0 | 21.8 | 17.9 |
| LCCO | 15.6 | 13.9 | 12.2 | 10.4 |
| Bottoms | 17.2 | 19.8 | 32.8 | 43.8 |
| $C_2$–$C_4$ Olefins | 11.5 | 23.1 | 23.3 | 20.7 |
| Saturated Gases | 7.4 | 9.1 | 9.2 | 7.4 |
| 15/220° C. Comp'n | | | | |
| Aromatics | 30.3 | 37.4 | 46.1 | 51.5 |
| Olefins | 25.0 | 26.6 | 26.0 | 25.0 |

These results show that cracking a conventional fluid catalytic cracking feed with catalyst mixtures containing high levels of ZSM-5 additive also produces relatively high yields of ethylene ($C_2H_2$), propylene ($C_3H_6$) and butylene ($C_4H_8$). However, catalyst mixtures containing 60 or 80% additive "ZZ" do not produce an more light olefins than mixtures containing 20% "ZZ" and 80% "ZA." Moreover, unconverted bottoms (BTMS) yields increased sharply as the level of additive "ZZ" was increased from 20 to 60 or 80%. These high bottoms yields are not economic.

At the same time, aromatic concentrations of 15/220° C. naphtha increased and 15/220° C. naphtha yields decreased as additive "ZZ" levels increased. This is because ZSM-5 additives produce light olefins by recracking 15/220° C. naphtha paraffins and olefins thereby concentrating naphtha aromatics. However, propylene and butylene produced by cracking feed RA+ can be used to produce alkylate, comprised of high octane isoparaffins. Alternately, isobutylenes can be used to produce methyl tertiary butyl ether (MTBE), a high octane oxygenate, for low emissions mogas. Blending this alkylate, or MTBE, with the 15/220° C. naphtha results in less aromatic, less olefinic gasoline blending stocks. This is shown in Table 11 below. Two cases are illustrated. The first case involves importing enough isobutane to alkylate all the propylene and butylene produced from feed RA+. The second case involves using only isobutane produced by cracking feed RA+ to alkylate butylene, then propylene, products from HA+.

TABLE II

Alkylating Propylene and Butylene Products from Cracking of Raw Arab Lt VGO on Catalysts ZA and ZZ

| | | | | |
|---|---|---|---|---|
| % Catalyst ZA | 100 | 80 | 40 | 20 |
| % Catalyst ZZ | 0 | 20 | 60 | 80 |
| Yields with Imports of Iso $C_4H_{10}$, Wt % | | | | |
| $C_3 + C_4$ Alkylate | 23.5 | 47.4 | 44.2 | 38.7 |
| Alkylate + 15/220° C. Naphtha | 69.1 | 79.4 | 66.0 | 36.0 |
| Alkylate + 15/220° C. Naphtha Comp'n | | | | |
| Aromatics | 20.1 | 15.1 | 15.2 | 16.3 |
| Olefins | 16.6 | 10.7 | 8.6 | 7.9 |
| Yields with NO Imports of Iso $C_4H_{10}$, Wt % | | | | |
| $C_3 + C_4$ Alkylate | 8.2 | 10.5 | 7.4 | 4.5 |
| Alkylate + 15/220° C. Naphtha | 54.2 | 42.5 | 29.2 | 22.4 |
| Alkylate + 15/220° C. Naphtha Comp'n | | | | |
| Aromatics | 25.7 | 28.1 | 34.4 | 41.1 |
| Olefins | 21.9 | 20.0 | 19.3 | 20.0 |

With conventional feed RA+, the combination of cat cracking and alkylation reduced overall naphtha aromatics levels at relatively high ZSM-5 additive levels, but highest naphtha yields were produced with mixtures containing 20% additive "ZZ". Further increases in additive "ZZ" levels resulted in lower yields of somewhat more aromatic naphtha. However, cracking conventional feed RA+ with ZSM-5 additives produced very little additional isobutane. Consequently, using even low levels of the additive boosted overall naphtha aromatics when only isobutane produced by cracking feed RA+ was available for alkylation.

This example illustrates limits to using ZSM-5 additives to produce low emissions fuels from conventional FCC feeds.

EXAMPLE 2

Further cracking tests were conducted at the same conditions, with the same catalysts, and in the same small fixed bed, MAT type testing unit which was described in Example 1.

The feed for these tests was the 345° C.+ fraction of an Arab Light VGO, hydrotreated at 2000 psig hydrogen and 380° C. with Ketjen's KF-840, a commercially available NiMo on alumina catalyst. The hydrotreated feed is designated by HA and the 345° C.+ fraction of HA is designated HA+. Properties of feed prior to distillation are given in the table below.

| Feed "HA" Properties | |
|---|---|
| Wppm N | 40.0 |
| Wt % S | 0.056 |
| Wt % C | 86.53 |
| Wt % H | 13.41 |
| Wt % 345° C.+ | 81.5 |

Detailed cracking data are given in Table III below for cracking the hydrotreated Arab Light VGO feed with these catalysts.

TABLE III

Cracking of Hydrotreated Arab Lt VGO on Catalysts ZA and ZZ

| % Catalyst ZA | 100 | 80 | 40 | 20 | 0 |
|---|---|---|---|---|---|
| % Catalyst ZZ | 0 | 20 | 60 | 80 | 100 |
| Conversion (220° C.) | 86.9 | 85.3 | 83.0 | 71.7 | 29.2 |
| Yields, Wt % | | | | | |
| Coke | 1.95 | 1.47 | 0.68 | 0.55 | 0.14 |
| $C_2^-$ Dry Gas | 2.10 | 2.66 | 3.49 | 4.60 | 3.41 |
| $C_3H_6$ | 6.44 | 12.96 | 16.42 | 12.66 | 6.06 |
| $C_3H_8$ | 1.35 | 2.10 | 2.60 | 3.45 | 2.24 |
| $C_4H_8$ | 5.42 | 10.48 | 13.41 | 11.55 | 4.75 |
| Iso $C_4H_{10}$ | 6.81 | 9.89 | 8.51 | 5.57 | 1.02 |
| N $C_4H_{10}$ | 1.04 | 1.30 | 1.33 | 1.59 | 1.03 |
| 15/220° C. | 61.7 | 44.4 | 36.6 | 31.7 | 10.6 |
| LCCO | 9.8 | 9.1 | 9.0 | 9.8 | 6.4 |
| BTMS | 3.4 | 5.6 | 8.0 | 18.5 | 64.4 |
| $C_2$–$C_4$ Olefins | 12.8 | 25.3 | 32.7 | 28.2 | 14.6 |
| Saturated Gases | 10.4 | 14.2 | 13.1 | 11.3 | 5.0 |
| 15/220° C. Comp'n | | | | | |
| Aromatics | 29.2 | 35.5 | 41.2 | 43.1 | 59.4 |
| Olefins | 13.3 | 16.0 | 24.5 | 29.1 | 28.0 |

These results show that high conversions of a clean FCC feed are feasible with catalyst mixtures containing as much as 60% ZSM-5 additive "ZZ" and only 40% of large pore cracking catalyst "ZA." Catalyst mixtures containing more than 60% additive "ZZ" were not as effective for converting clean feed HA+ to LCCO and 220° C.− products. Cracking catalyst mixtures containing relatively high levels of the ZSM-5 additive provided high yields of ethylene ($C_2H_2$), propylene ($C_3H_6$) and butylene ($C_4H_8$) products. Maximum yields of these valuable light olefins were produced with mixtures containing about 60% additive "ZZ." As a result, more light olefins were produced from the clean fe invention than from the conventional feed cracking experiments described in Example 1.

At the same time, cracking catalyst mixtures containing ZSM-5 additives boosted naphtha aromatics concentrations. As before, propylene and butylene produced by cracking feed HA+ can be used to produce high octane isoparaffins or MTBE for low emissions mogas. Blending this alkylate or MTBE with the 15/220° C. naphtha results in less aromatic, less olefinic gasoline blending stocks. This is shown in Table IV below. Again, two cases are illustrated. The first case involves importing enough isobutane to alkylate all the propylene and butylene produced from HA+. The second case involves using only isobutane produced by cracking feed HA+ to alkylate butylene, then propylene products from HA+.

TABLE IV

Alkylating Propylene and Butylene Products from Cracking of Hydrotreated Arab Lt VGO on Catalysts ZA and ZZ

| % Catalyst ZA | 100 | 80 | 40 | 20 | 0 |
|---|---|---|---|---|---|
| % Catalyst ZZ | 0 | 20 | 60 | 80 | 100 |
| Yields with Imports of Iso $C_4H_{10}$, Wt % | | | | | |
| $C_3 + C_4$ Alkylate | 26.3 | 52.1 | 66.3 | 53.6 | 24.1 |
| Alkylate + 15/220° C. | 88.0 | 96.5 | 102.9 | 85.3 | 34.7 |
| Alkylate + 15/220° C. Comp'n | | | | | |
| Aromatics | 20.5 | 16.3 | 14.6 | 16.0 | 18.1 |
| Olefin | 9.3 | 7.4 | 8.7 | 10.8 | 8.5 |
| Yields with NO Imports of Iso $C_4H_{10}$, Wt % | | | | | |
| $C_3 + C_4$ Alkylate | 13.1 | 19.5 | 16.8 | 11.0 | 2.0 |
| Alkylate + 15/220° C. | 74.8 | 63.9 | 53.4 | 42.7 | 12.6 |
| Alkylate + 15/220° C. Comp'n | | | | | |
| Aromatics | 24.1 | 24.7 | 28.2 | 32.0 | 50.0 |
| Olefins | 10.9 | 11.1 | 16.8 | 21.6 | 23.6 |

Gasoline products containing low levels of aromatic and olefinic compounds were produced from clean feeds with cracking catalyst mixtures containing relatively high levels of ZSM-5 additives. Given sufficient isobutane imports, the highest yield of low aromatic content gasoline blending stocks were produced with a catalyst mixture containing 60% additive "ZZ." Even when using only isobutane produced by cracking clean feed HA+ to alkylate butylene and propylene products, gasoline aromatic levels were maintained at 25% or less with cracking catalyst mixtures containing 20% additive "ZZ."

This example shows, therefore, that higher levels of ZSM-5 additives can be used to produce more light olefins and isobutane for alkylation or MTBE, and higher yields of less aromatic naphthas from clean FCC feeds than from conventional feeds.

EXAMPLE 3 (COMPARATIVE)

Further cracking tests were conducted at the same conditions and in the same small fixed bed, MAT type testing unit which was described in Example 1. Catalyst used for these experiments was a Catalyst "ZA" described in Example 1.

The 345° C.+ fraction of several hydrotreated Arab Light VGO products were used as feeds for these cat cracking experiments. Feed for the hydrotreating experiments was the same raw feed described in Example 2. Hydrotreating conditions ranged from 1200 to 2000 psig hydrogen, 370° to 380° C., and 0.15 to 1.5 LHSV. Ketjen's KF-843, a commercially available NiMo/alumina catalyst was used to hydrotreat the feeds. The hydrotreated feeds are designated by HA followed by a number indicating hydrotreating severity which increases from HA5+ to HA1+.

Properties of Hydrotreated Arab LVGO's

| | HA5+ | HA4+ | HA3+ | HA2+ | HA1+ |
|---|---|---|---|---|---|
| Wppm N | 130 | 40 | 4 | 0.7 | <.5 |
| Wt % S | 0.08 | 0.03 | <0.01 | <0.01 | <0.01 |
| Wt % C | 86.90 | 86.90 | 86.44 | 86.11 | 85.70 |
| Wt % H | 13.10 | 13.10 | 13.56 | 13.89 | 14.30 |
| Wt % Sats. | 62.3 | 65.4 | 79.9 | 93.7 | 95.7 |
| Wt % 1R - Arom | 27.8 | 26.7 | 15.7 | 4.2 | 2.3 |
| Wt % Tot. Cores | 11.3 | 10.0 | 6.4 | 2.0 | 1.3 |
| Wt % 2 + R Cores | 6.3 | 5.0 | 3.2 | 1.4 | 1.0 |

Detailed cracking data are given in Table V below for these hydrotreated feeds.

TABLE V

Cracking of Hydrotreated Arab Lt VGO's on Catalyst ZA

| Feed | HA5+ | HA4+ | HA3+ | HA2+ | HA1+ |
|---|---|---|---|---|---|
| Conversion (220° C.) | 79.4 | 80.8 | 87.0 | 92.6 | 96.0 |
| Yields, Wt % | | | | | |
| Coke | 2.1 | 2.02 | 1.55 | 1.45 | 1.82 |
| $C_2^-$ Dry Gas | 2.09 | 1.95 | 2.00 | 1.85 | 1.70 |
| $C_3H_6$ | 6.09 | 6.63 | 6.69 | 7.27 | 9.79 |
| $C_3H_8$ | 1.08 | 1.11 | 1.10 | 1.28 | 1.39 |
| $C_4H_8$ | 7.38 | 6.66 | 8.10 | 8.95 | 10.53 |
| Iso $C_4H_{10}$ | 6.24 | 6.77 | 7.63 | 9.28 | 9.90 |
| N $C_4H_{10}$ | 0.878 | 0.971 | 0.985 | 0.98 | 1.54 |
| 15/220° C. | 53.5 | 54.6 | 58.8 | 61.5 | 59.3 |
| LCCO | 13.2 | 12.5 | 9.3 | 5.85 | 3.7 |
| BTMS | 7.4 | 6.7 | 3.7 | 1.6 | 0.3 |
| 15/220° C. Comp'n | | | | | |
| Aromatics | 29.9 | 29.4 | 25.6 | 25.2 | 21.8 |
| Olefins | 20.2 | 20.2 | 21.2 | 18.9 | 21.7 |

Conversion and naphtha yields increases sharply as feed aromatics and nitrogen are reduced. In addition, aromatic contents of cat naphthas produced from these clean feeds decreased as feed aromatics and nitrogen were reduced. Finally, yields of $C_3$ and $C_4$ olefins increased somewhat as cracking feed aromatic cores and organic nitrogen were reduced.

Propylene and butylene produced from these feeds can be used to produce alkylate and MTBE. Blending high octane, non-aromatic alkylate and MTBE will further reduce aromatics concentrations of gasoline blend stocks produced by FCC. This is shown in Table VI below.

TABLE VI

Alkylating Propylene and Butylene Products from Cracking Hydrotreated Arab Lt VGO's on Catalyst "ZA"

| Feed | HA5+ | HA4+ | HA3+ | HA2+ | HA1+ |
|---|---|---|---|---|---|
| Yields with Imports of Iso $C_4H_{10}$, Wt % | | | | | |
| $C_3 + C_4$ Alkylate | 29.5 | 29.3 | 32.4 | 35.4 | 44.7 |
| Alkylate + 15/220° C. | 83.02 | 83.9 | 91.2 | 97.0 | 104.0 |
| Alkylate + 15/220/20 C. | | | | | |
| Comp'n | | | | | |
| Aromatics | 19.3 | 19.1 | 16.5 | 16.0 | 12.4 |
| Olefins | 13.0 | 13.1 | 13.7 | 12.0 | 12.3 |

EXAMPLE 4

Further cracking tests were conducted at the same conditions and in the same small fixed bed, MAT type testing unit which was described in Example 1. The same hydrotreated Arab Light VGO products, described in Example 3 were used as feeds for cat cracking experiments. Catalysts used for these experiments were Catalysts "ZA" and "ZZ" described in Example 1.

Detailed cracking data are given in Table VII below for the hydrotreated feeds.

TABLE VII

Cracking of Hydrotreated Arab Lt VGO's on 50/50 Mixture of Catalysts ZA and ZZ

| Feed | HA5+ | HA4+ | HA3+ | HA2+ | HA1+ |
|---|---|---|---|---|---|
| Conversion (220° C.) | 75.3 | 78.8 | 85.3 | 90.2 | 94.6 |
| Yields, Wt % | | | | | |
| Coke | 1.077 | 0.950 | 0.898 | 0.896 | 0.897 |
| $C_2^-$ Dry Gas | 5.29 | 5.51 | 5.88 | 5.69 | 6.59 |
| $C_3H_6$ | 13.30 | 14.04 | 15.86 | 16.51 | 16.26 |
| $C_3H_8$ | 3.54 | 4.13 | 4.62 | 4.33 | 5.26 |

TABLE VII-continued

Cracking of Hydrotreated Arab Lt VGO's on 50/50 Mixture of Catalysts ZA and ZZ

| Feed | HA5+ | HA4+ | HA3+ | HA2+ | HA1+ |
|---|---|---|---|---|---|
| $C_4H_8$ | 11.22 | 11.35 | 11.97 | 13.39 | 11.89 |
| Iso $C_4H_{10}$ | 6.48 | 8.18 | 9.00 | 9.53 | 9.99 |
| N $C_4H_{10}$ | 1.52 | 1.87 | 2.35 | 1.94 | 2.99 |
| 15/220° C. | 32.8 | 32.7 | 34.7 | 37.9 | 40.7 |
| LCCO | 12.2 | 11.22 | 8.23 | 5.99 | 3.93 |
| BTMS | 12.5 | 9.96 | 6.48 | 3.77 | 1.42 |
| 15/220° C. Comp'n | | | | | |
| Aromatics | 47.3 | 48.5 | 42.9 | 38.9 | 44.0 |
| Olefins | 25.5 | 20.9 | 23.5 | 17.5 | 24.2 |

In comparison to results obtained with catalyst "ZA" alone, cracking these clean feeds with mixtures of catalyst "ZA" and "ZZ" boosted propylene and butylene yields. Using the ZSM-5 additive also boosted naphtha aromatics levels. Naphtha yields and naphtha aromatics levels for cat naphtha plus alkylate are shown in Table VIII below.

TABLE VIII

Alkylating Propylene and Butylene Products from Cracking Hydrotreated Arab Lt VGO on 50/50 Mixture of Catalysts "ZA" and "ZZ"

| Feed | HA5+ | HA4+ | HA3+ | HA2+ | HA1+ |
|---|---|---|---|---|---|
| Yields with Imports of Iso $C_4H_{10}$, Wt % | | | | | |
| $C_3 + C_4$ Alkylate | 54.4 | 56.4 | 62.0 | 66.5 | 62.8 |
| Alkylate + 15/220° C. | 87.2 | 89.2 | 96.7 | 104.4 | 103.5 |
| Alkylate + 15/220° C. Comp'n | | | | | |
| Aromatics | 17.8 | 17.8 | 15.4 | 14.1 | 17.3 |
| Olefins | 9.6 | 7.7 | 8.4 | 6.4 | 9.5 |

Cat naphtha plus alkylate yields increased, then leveled off as feed aromatic cores and nitrogen levels were reduced. At the same time overall aromatics level for 15/220° C. naphtha plus alkylate decreased to a minimum value for feed HA2+ then increased slightly. In comparison to results with catalyst "ZA" alone, total naphtha yields were higher and overall naphtha aromatic levels were lower for all feed but "HA1+." Overall naphtha olefins levels were also lower.

These results indicate an optimum feed hydrogen content between 13.0 and 14.0 wt% for producing high yields of low emissions fuels using mixtures of cracking catalyst and ZSM-5 additive.

EXAMPLE 5

Cracking tests demonstrating a preferred embodiment of this invention were conducted in the same small fixed bed MAT type testing unit described in Example 1, using the same hydrotreated feed described in Example 2. Two catalysts were used for these experiments. The first was a fresh steamed 3A amorphous silica/alumina catalyst. The catalyst was steamed 16 hours at 760° C. to simulate commercially deactivated catalysts. Catalyst inspections for this 3A catalyst are given below. The second catalyst was Additive ZZ described in Example 1.

| Source Name | Davison 3A |
|---|---|
| Stmd 16 hrs @ 760° C. | |
| S.A., $M^2/g$ | 128 |
| P.V., cc./g | 0.49 |

-continued

| Source Name | Davison 3A |
|---|---|
| Unit Cell, Å | n/a |

Detailed cracking data are given in Table IX below for cracking the hydrotreated VGO feed with 3A and Additive ZZ.

TABLE IX

Cracking of Hydrotreated Arab Lt VGO on Catalysts 3A and ZZ

| | | | |
|---|---|---|---|
| % Catalyst 3A | 100 | 50 | 0 |
| % Catalyst ZZ | 0 | 50 | 100 |
| Conversion (220° C.) | 64.4 | 60.1 | 29.2 |
| Yields, Wt % | | | |
| Coke | 0.9 | 0.8 | 0.1 |
| $C_2^-$ Dry Gas | 1.3 | 4.4 | 3.4 |
| $C_3H_6$ | 4.7 | 12.8 | 6.1 |
| $C_3H_8$ | 0.3 | 2.6 | 2.2 |
| $C_4H_8$ | 9.4 | 11.3 | 4.8 |
| Iso-$C_4H_{10}$ | 2.5 | 3.3 | 1.0 |
| N—$C_4H_{10}$ | 0.3 | 1.1 | 1.0 |
| 15/220° C. | 45.0 | 23.7 | 10.6 |
| LCCO | 11.1 | 8.8 | 6.4 |
| Bottoms | 24.5 | 31.1 | 64.4 |
| $C_2$–$C_4$ Olefins | 14.7 | 27.8 | 14.6 |
| Saturated Gases | 3.9 | 11.4 | 5.0 |
| 15/220° C. Comp'n | | | |
| Aromatics | 23.0 | 40.4 | 58.0 |
| Olefins | 46.8 | 35.9 | 22.1 |

These results show that the clean feed, HA+, was cracked effectively with a catalyst mixture containing 50% ZSM-5 additive "ZZ" and 50% of an amorphous silica/alumina 3A catalyst. Although conversion of this clean feed was slightly less than the conversion obtained with the amorphous silica/alumina, 3A catalyst alone, $C_2$–$C_4$ olefins yields were significantly higher.

On the other hand, cracking catalyst mixtures containing ZSM-5 additives boosted naphtha aromatics concentrations. Even so, propylene and butylene produced by cracking feed HA+ can be used to produce high octane isoparaffins or MTBE. Blending this alkylate or MTBE with the 15/220° C. naphtha product results in less aromatic, less olefinic gasoline blending stocks. This is shown in Table X below. This case involves importing enough isobutane to alkylate all the propylene and butylene produced from feed HA+.

TABLE X

Alkylating Propylene and Butylene Products from Cracking of Hydrotreated Arab Lt VGO on 3A and ZZ Catalysts

| | | | |
|---|---|---|---|
| % Catalyst 3A | 100 | 50 | 0 |
| % Catalyst ZZ | 0 | 50 | 100 |
| Yields with Imports of Iso $C_4H_{10}$, Wt % | | | |
| $C_3$ + $C_4$ Alkylate | 30.2 | 54.0 | 24.1 |
| Alkylate + 15/220° C. | 75.2 | 77.7 | 34.6 |
| Alkylate + 15/220° C. Comp'n | | | |
| Aromatics | 13.8 | 12.3 | 17.8 |
| Olefins | 28.0 | 11.0 | 6.7 |

This example shows, therefore, that high levels Of ZSM-5 additives can be Used with amorphous silica/alumina catalysts to produce a 15/220° C. naphtha and light olefins for alkylation or MTBE. Alkylating the olefins and blending this alkylate with the 15/220° C. naphtha product provides good low emissions gasoline blending stocks. This blend of alkylate plus cat naphtha is less aromatic than the naphtha plus alkylate produced by cracking either conventional or clean feeds with zeolitic catalyst mixtures. This is shown by comparing these results with results reported in Example 2. Moreover, this alkylate naphtha blend is substantially less olefinic than naphtha produced with 3A catalyst alone. This is particularly useful, since 3A catalysts produce naphthas which may be too olefinic for low emissions fuels.

What is claimed is:

1. A fluid catalytic cracking process for producing low emission fuel products, which process comprises the steps of:

(a) introducing a hydrocarbonaceous feedstock into a reaction zone of a catalytic cracking unit comprised of a reaction zone, stripping zone, and a regeneration zone, which feedstock is characterized as having: an initial boiling point from about 230° C. to about 350° C., with end points up to about 620° C.; a nitrogen content less than about 50 wppm; a hydrogen content in excess of about 13 wt. %; a 2+ ring aromatic core content of less than about 7.5 wt. %; and an overall aromatic core content of less than about 15 wt. %;

(b) catalytically cracking said feedstock in said reaction zone at a temperature from about 450° C. to about 600° C., by causing the feedstock to be in contact with a cracking catalyst for a contact time of about 1 to 5 seconds, which cracking catalyst is a mixture of zeolite-Y and ZSM-5 zeolite, or an amorphous acidic catalytic material having a surface area, after steaming at 760° C. for 16 hours, from about 75 to 200 $m^2/g$, and ZSM-5, or a combination of all three; and (c) stripping recovered used catalyst particles with a stripping fluid in a stripping zone to remove therefrom some hydrocarbonaceous material; and (d) recovering stripped hydrocarbonaceous material from the stripping zone and circulating stripped used catalyst particles to the regenerator or regeneration zone; and (e) regenerating said coked catalyst in a regeneration zone by burning-off a substantial amount of the coke on said catalyst, and with any added fuel component to maintain the regenerated catalyst at a temperature which will maintain the catalytic cracking reactor at a temperature from about 450° C. to about 600° C.; and (f) recycling said regenerated hot catalyst to the reaction zone.

2. The process of claim I wherein the catalyst contains from about 0 wt. % to 50 wt. % zeolite-Y and from about 1 wt. % to 50 wt. % ZSM-5 zeolite.

3. The process of claim 2 wherein the catalyst contains from about 5 wt. % to 40 wt. % zeolite-Y and about ZSM-5.

4. The process of claim 3 wherein the hydrocarbonaceous feedstock contains: less than about 20 wppm nitrogen, greater than about 13.5 wt. % hydrogen, less than about 4 wt. % of 2+ ring aromatic cores, and an overall aromatic core content of less than about 8 wt. %.

5. The process of claim 1 wherein the catalyst is an amorphous silica/alumina material containing from about 15 to 25 wt. % alumina combined with ZSM-5.

6. The process of claim 4 wherein the catalyst is zeolitic material in an inorganic matrix, which zeolitic material is a Y type zeolite having a unit cell size of 24.25 Å or less.

7. The process of claim 1 wherein each of the catalyst components are on the same catalyst particle.

8. The process of claim 1 wherein the zeolite Y is on a catalyst particle separate from zeolite ZSM-5.

* * * * *